US007690554B2

(12) United States Patent
Zacher et al.

(10) Patent No.: US 7,690,554 B2
(45) Date of Patent: Apr. 6, 2010

(54) ANTI-SIFTING POLYGONAL CARTON AND METHODS OF ASSEMBLY

(75) Inventors: Raymond L. Zacher, West Chester, OH (US); Allen M. Brandenburger, Decatur, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 722 days.

(21) Appl. No.: 11/548,959

(22) Filed: Oct. 12, 2006

(65) Prior Publication Data

US 2007/0063002 A1 Mar. 22, 2007

Related U.S. Application Data

(63) Continuation-in-part of application No. 11/347,915, filed on Feb. 6, 2006.

(60) Provisional application No. 60/652,598, filed on Feb. 14, 2005.

(51) Int. Cl.
*B65D 5/00* (2006.01)
*B65D 17/00* (2006.01)

(52) U.S. Cl. ..... 229/109; 229/222

(58) Field of Classification Search ..... 229/108, 229/109, 200, 204, 207, 227, 101.1, 123.3; 206/822

See application file for complete search history.

(56) References Cited

U.S. PATENT DOCUMENTS

| | | | | |
|---|---|---|---|---|
| 1,425,549 | A | | 8/1922 | Scruby |
| 1,892,715 | A | | 1/1933 | Wellman |
| 2,565,188 | A | | 8/1951 | Welshenbach |
| 2,787,408 | A | | 4/1957 | Andre |
| 3,844,088 | A | | 10/1974 | McDonough et al. |
| 3,907,194 | A | | 9/1975 | Davenport et al. |
| 3,944,072 | A | | 3/1976 | Budington et al. |
| 3,990,210 | A | | 11/1976 | McDonough et al. |
| 4,084,693 | A | * | 4/1978 | Culpepper ..... 206/427 |
| 4,094,124 | A | | 6/1978 | Ljungcrantz |
| 4,119,266 | A | | 10/1978 | Dempster |
| 4,225,078 | A | | 9/1980 | Croley |
| 4,260,100 | A | | 4/1981 | Hoffman |
| 4,360,146 | A | | 11/1982 | Koltz |
| 4,361,267 | A | | 11/1982 | Wozniacki |
| 4,392,607 | A | | 7/1983 | Perkins, Jr. |
| 4,448,008 | A | | 5/1984 | Pankratz et al. |
| 4,470,540 | A | | 9/1984 | Koltz |
| 4,702,408 | A | | 10/1987 | Powlenko |

(Continued)

*Primary Examiner*—Nathan J Newhouse
*Assistant Examiner*—Christopher Demeree
(74) *Attorney, Agent, or Firm*—Wombie Carlyle Sandridge & Rice, PLLC

(57) ABSTRACT

An anti-sifting polygonal carton stores granulated and powdered products. The carton starts as a single blank with four sections: a side, a front, a side, and a rear. The sides have a side panel with two flanking miter panels and two minor flaps. Each miter panel has two opposite miter flaps. The front has a front panel with a second major flap having a tear strip and an opposite second major lower flap having a crease. Separated from the front by a side, the rear has a rear panel having a miter tab opposite the side and a first major flap and an opposite first major lower flap. The fold lines continuous with the miter flaps and the miter tab are reinforced with tape or patches. The tear strip and top of the carton have a pattern of cuts to open and to reclose the carton.

12 Claims, 4 Drawing Sheets

U.S. PATENT DOCUMENTS 4,944,405 A * 7/1990 Buford et al. ..... 229/240
4,984,734 A 1/1991 Zion et al.
5,366,141 A * 11/1994 Stone ..... 229/120.03
5,630,543 A 5/1997 Dugan
5,704,540 A 1/1998 Coalier et al.
5,752,648 A 5/1998 Quaintance
5,878,946 A 3/1999 Frerot et al.
5,938,108 A 8/1999 Williams et al.
5,941,452 A 8/1999 Williams et al.
5,943,840 A 8/1999 Nilsson et al.
6,042,527 A 3/2000 Anderson et al.
6,202,920 B1 3/2001 Auclair
6,446,859 B1 9/2002 Holladay
6,471,102 B2 10/2002 Hancock
6,588,651 B2 7/2003 Quaintance
6,783,058 B2 8/2004 Quaintance
6,932,266 B2 8/2005 Jones et al.
2005/0263573 A1 12/2005 Goglio
2005/0284922 A1 12/2005 Feltz
2006/0027638 A1 2/2006 Jones et al.
2006/0169755 A1 8/2006 Spivey, Sr.
2006/0180642 A1 8/2006 Zacher et al.

* cited by examiner

ANTI-SIFTING POLYGONAL CARTON AND METHODS OF ASSEMBLY

CROSS REFERENCE TO RELATED APPLICATIONS

This application claims is a continuation-in-part of U.S. patent application Ser. No. 11/347,915, filed Feb. 6, 2006, which claims priority to U.S. Provisional Patent Application Ser. No. 60/652,598, filed Feb. 14, 2005, the contents of both of which are hereby incorporated by reference.

BACKGROUND OF THE INVENTION

This application relates generally to polygonal cartons used in packaging bulk product packages and more particularly, to polygonal cartons used in packaging granular detergent or other material packaging.

At least some known polygonal cartons use a combination of major, minor, and/or miter panels to facilitate sealing the corners of the polygonal carton in the bottom and the top. Such cartons, when folded and glued upon the bottom, receive a product in a main compartment defined therein, and the top is then folded and glued to seal the carton for shipping.

Carton designs used in packaging bulk granular products, such as laundry and dishwashing detergents, rice, cereals, pet litter, and dry pet foods, are fabricated with both partial and full seal end constructions. However, if moisture reaches the contents of such cartons, such as bulk granular products, generally the product is activated, as is the case with detergents, or deteriorates as may occur with foods and pet products. To prevent spoilage of such products, generally dry bulk products require a moisture resistant and sealed carton that prevents direct contact of the bulk product with moisture, such as water, and indirect contact such as through humidity. Moreover, dry bulk products must meet customer expectations and reduce the losses encountered by bulk product distributors. In addition, to further meet customer expectations and to reduce losses that may be encountered by distributors, cartons must minimize sifting of product out of the carton.

Beginning as a blank, known cartons start as a continuous plane or blank of material, such as paperboard. After folding, stress points may be created in the blank at each fold, and more particularly, at each corner. In addition, rectangular-shaped cartons generally are susceptible to sifting because the corners of such containers endure stress from folding along two axes. Moreover, during shipping and handling, the corners of such cartons may wear down and over time, may enable the product to be inadvertently released through a process commonly called sifting.

The present invention provides an octagonal shaped carton that contains bulk granulated product while minimizing sifting from the carton. Traditionally, cartons are folded and erected into a generally rectangular finished shape. The present invention utilizes a carton formed by specialized machinery that erects a carton and securely seals the end flaps.

DESCRIPTION OF THE PRIOR ART

Containers, or cartons, for bulk, or granulated, products are known in the prior art. Older cartons held the granulated products within octagonal shapes, such as with gussets. However, a combination of major, minor, and miter flaps, folded and glued by specialized machinery make few appearances in the prior art.

For example, U.S. Pat. No. 1,892,715 to Wellman, is directed to a receptacle in its blank from. The receptacle contains a plurality of side walls that overlap, when glued, into the configuration of an octagonal shaped carton. In addition, the carton contains an integral bottom wall and likewise has a top closure, when folded into its usable configuration.

Moreover, U.S. Pat. No. 2,787,408 illustrates a quick set-up folding container, bag-like and hexagonal in shape.

The U.S. patent to McDonough, et al., U.S. Pat. No. 3,844,088, is directed to machinery for folding and packaging containers, in conjunction with the use of specialized machinery.

The U.S. patent to Budington, et al., U.S. Pat. No. 3,944,072, shows an octagonal dispenser carton for band saw coils. This carton just forms an octagonal shape, apparently of a shallow dimension.

U.S. Pat. No. 3,990,210 shows a very similar mandrel formed carton which is a divisional patent of the McDonough '088 patent described above.

The patent to Ljungcranzt, U.S. Pat. No. 4,094,124, shows a process and apparatus for the manufacture of filled closed containers. The apparatus incorporates a mandrel for shaping a blank, into a carton, during its erection, and filling.

The patent to Koltz, U.S. Pat. No. 4,360,146, is directed to an open top, set-up container. This container forms into a uniquely multi-sided container, somewhat cone-shaped, with a bottom, but having an open top.

The patent to Pankratz, et al., U.S. Pat. No. 4,448,008, shows another multiple mandrel carton erecting, filling, and sealing machine that uses two-stage loading.

U.S. Pat. No. 4,470,540, is directed to an open top, set-up container with a uniquely shaped, albeit octagonal, form and a uniquely folded bottom.

The patent to Zion, et al., U.S. Pat. No. 4,984,734, is directed to a stackable articulated carton tray apparatus wherein the carton is a shallow, octagonal-shaped carton.

U.S. Pat. No. 1,425,549, discloses a symmetrical octagonal carton, formed as a paperboard box for containing hats and other millinery products. A plurality of side panels form the octagonal shape and the bottom panels fold over to provide closure. Upper panels incorporate a pair of major flaps, miter end flaps, and miter flaps that are arranged intermediate thereof, and which are folded over to accommodate an overlying relationship with the major and miter flaps, and adhered thereto for closure.

U.S. Pat. No. 2,565,188, is directed to shows another polygonal box, an octagon. The box includes a variety of flaps, functioning as major flaps, with a series of miter flaps, which interlock with the major flaps during closure.

U.S. Pat. No. 4,119,266, describes an octagonal shaped paperboard bin that includes slotted flaps for retention of the top of the carton.

U.S. Pat. No. 4,225,078, describes a knocked-down polygonal container with set-up contour-forming flaps. The container is open at its top, and its bottom includes a series of flaps that fold inwardly to form a bottom closure.

U.S. Pat. No. 4,260,100, is directed to a container closure including a series of end flaps that are pivotally connected to the sides of the outer closure panels to close the top of the carton. The flaps tuck into the carton, rather than providing any type of a miter support for the erected carton.

U.S. Pat. No. 4,361,267, describes a four-corner design for an octagonal container wherein corner flaps provide an engagement flap, for tuck-in purposes, to secure the container into closure.

U.S. Pat. No. 4,392,607, is directed to a carton including integral closures that form an octagonal shape and that overlap a plurality of top miter flaps to engage with flap strips.

U.S. Pat. No. 4,702,408, describes a bulk bin formed into an octagonal shape designed for the shipment of heavy quantities of fresh meat. A top closure is not described and its bottom closure incorporates a variety of flaps that tuck into each other.

U.S. Pat. No. 5,630,543, describes a one-piece octagonal box including closure and folding flaps that have more of the bellows style of closure.

U.S. Pat. No. 6,446,859, describes a foldable storage container that is an octagonal box. Its upper closure forms a recessed closure. And it includes lid panels that are sized to fit within polygonal folded sheets.

U.S. Pat. No. 6,471,102, is directed to an easy-opening handled carton, that includes a tear strip, which when opened, enables a central portion of the major panel to be pulled free. In the carton, top and bottom units are attached to the inner surface of the walls.

U.S. Pat. No. 6,588,651, describes an octagonal bulk bin. At least one side wall includes at least one score line that is weakened to buckle the wall in a controlled manner.

U.S. Pat. No. 5,704,540, describes a carton fabricated with rigid sheet material and a handle. The carton folds into an octagonal shape.

U.S. Pat. No. 5,878,946, describes a carton or cover of rigid sheet material with a reinforced handle, and a blank and process for manufacturing the same. The carton, when formed, generally has an octagonal shape.

U.S. Pat. No. 5,943,840, to Nilsson, et al., is directed to a method and apparatus for forming a top of a container. The carton, when assembled upon the multi-mandrel machine, is generally rectangular.

U.S. Pat. No. 6,042,527, is directed to a carton forming device which is used to form a rectangular carton.

U.S. Pat. No. 6,202,920, describes a gusseted carton, which uses its end formation, including all of its gussets, forms the shape of its top panels, which are octagonal.

While the above-described patented devices fulfill their respective, particular objectives and requirements, none of the aforementioned patents describe nor suggest an anti-sifting polygonal carton that facilitates eliminating forming, sifting, and sealing problems. As such, a need exists for a new and improved polygonal carton that can be formed using specialized machinery, for accurate folding and sealing of one end of the carton. In this regard, the present invention substantially fulfills this need.

Further, the polygonal carton according to the present invention substantially departs from the conventional concepts and designs of the prior art, and in doing so provides a device primarily developed for the purpose of sealing and reinforcing carton corners to reduce sifting of granulated products from cartons.

BRIEF SUMMARY OF THE INVENTION

Generally, the present invention provides a single piece bulk granular product carton. The carton comprises a blank having major flaps, lower major flaps, minor flaps, miter flaps, emboss pads, a front panel, a rear panel, miter panels, notches, and a tear strip. The panels form a polygonal such as an octagon-shaped carton with the flaps used for closing the ends of the carton. The flaps overlap to seal the four corners of each end. With sealed ends, sifting and/or other losses of granulated product from the carton are facilitated to be reduced.

The polygonal carton addresses the sifting problem with a combination of minor flaps, miter flaps, emboss pads, and offset scores in various locations. Upon forming the carton, the first-down major flap is folded by intricate machinery to support the structure. Next, the minor and miter flaps are flared by the intricate machinery and glue is extruded onto the structure to "caulk" all potential points of leakage holes. Moreover, a deboss area at each end of the major flap enables more glue to fill-in gaps that may be formed between the major, miter, and minor panels, such that an amount of stress induced to each corner is reduced, and such that the likelihood of creating sift openings is also facilitated to be reduced.

Then, the intricate machinery is used to fold and retain the major and miter flaps into place. Finally, intricate machinery is used to force the last-down major flap into place to create an eight-sided sift-resistant structure that can be produced with high production speeds. Specifically, the present invention forms upon specialized machinery that allows gluing of all flaps. Gluing occurs as machinery first forms the blank into a tube as the precursor to a carton. The bottom of the carton is then formed as the minor and miter flaps are flared out and the first major flap is folded. Glue is then applied to the first major flap, thereupon the minor and miter flaps are folded to meet the first major flap, thus being securely glued and sealed. After gluing the minor and miter flaps, the second major lower flap is folded and glued to the minor, miter and first major flap such that the minor and miter flaps are layered between the first and second major flaps. This seals the bottom of the carton. After insertion of the granulated product into the open carton, the same process used for folding and sealing the bottom of the carton is used for the top of the carton. The carton is now ready for shipping and sale to consumers.

After insertion of the granulated product into the opposite, currently open end of the carton, substantially the procedure as outlined above, is used to form, fold, and seal the other end of the carton. The carton is now ready for shipping and sale to consumers.

Without offset scores on the miter flaps, the carton has a closer and more airtight seal. Further, pinhole gaps have less effect as each miter, front and rear, and side panel is folded at forty-five degrees to form the octagonal carton. Moreover, all minor panels meet when formed, thus mitigating stress and/or fiber tears at the corners. An emboss pad on the second major lower flap fills the gap created by the partial overlap of the first major lower flap when sealing the bottom of the carton.

Preferably, the anti-sifting polygonal carton is a paperboard container of a single blank of material that forms an eight-sided carton. The carton includes trapezoidal minor flaps upon four miter panels, two side panels with attached minor flaps, and front and back panels with attached major flaps. The major flaps enable opening and re-closing of the top, when initiated by a tear strip opener.

Numerous objects, features and advantages of the present invention will be readily apparent to those of ordinary skill in the art upon a reading of the following detailed description of presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a new and improved polygonal carton that contains granulated product without sifting.

Another object is to provide such a carton that is octagonal in shape that differentiates the carton from other manufactures in the eyes of the consumer.

Another object is to provide such a carton that is formed upon specialized machinery for accuracy of folding and integrity of sealing.

Another object is to provide such a carton that has a higher vertical load capacity, or top load compression strength, than rectangular cartons allowing for higher stacking of cartons at warehouses.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

The same reference numerals refer to the same parts throughout the various Figures.

DETAILED DESCRIPTION OF THE INVENTION

Figure 1:
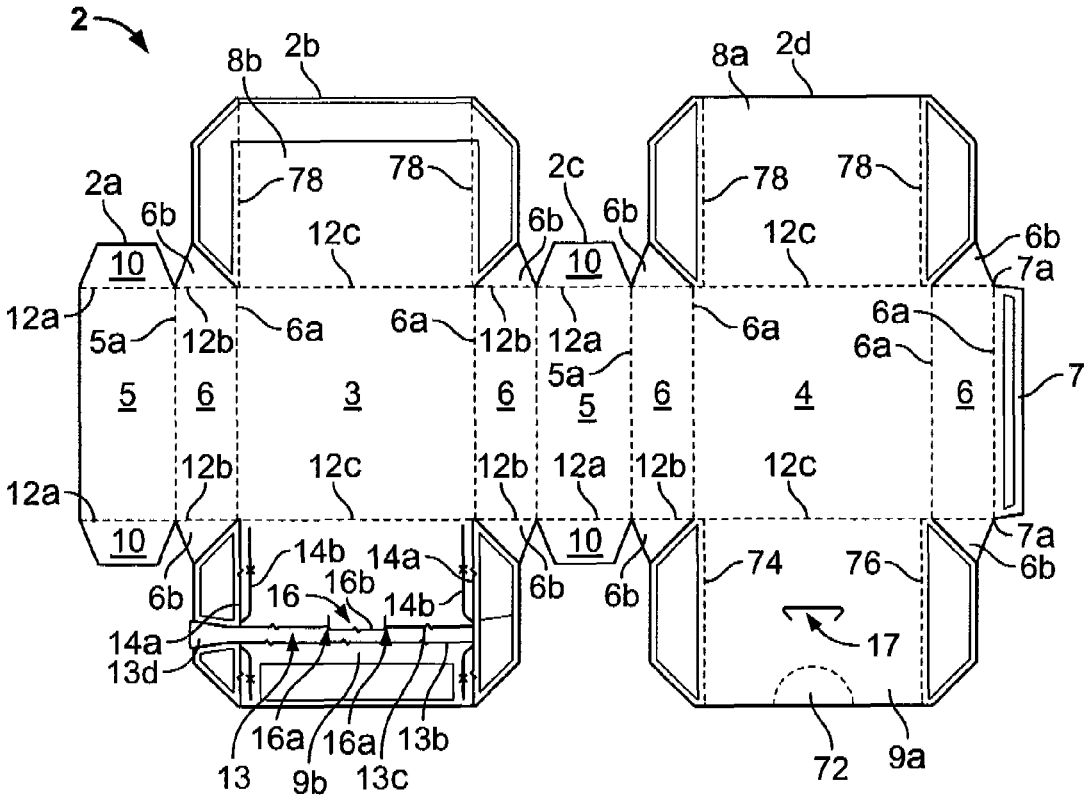
FIG. 1 illustrates a plan view of a reverse face of a blank of an exemplary embodiment of an anti-sifting polygonal carton assembled in accordance with the principles of the present invention.
Figure 1A:
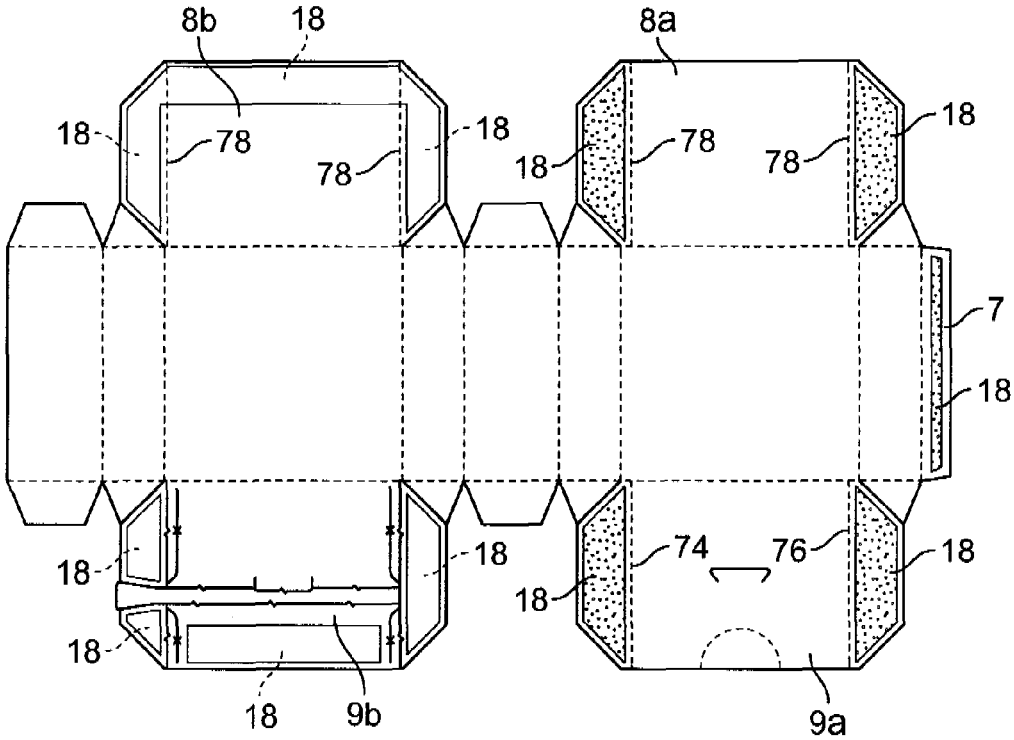
FIG. 1A illustrates adhesive applied to the blank shown in FIG. 1.
Figure 2:
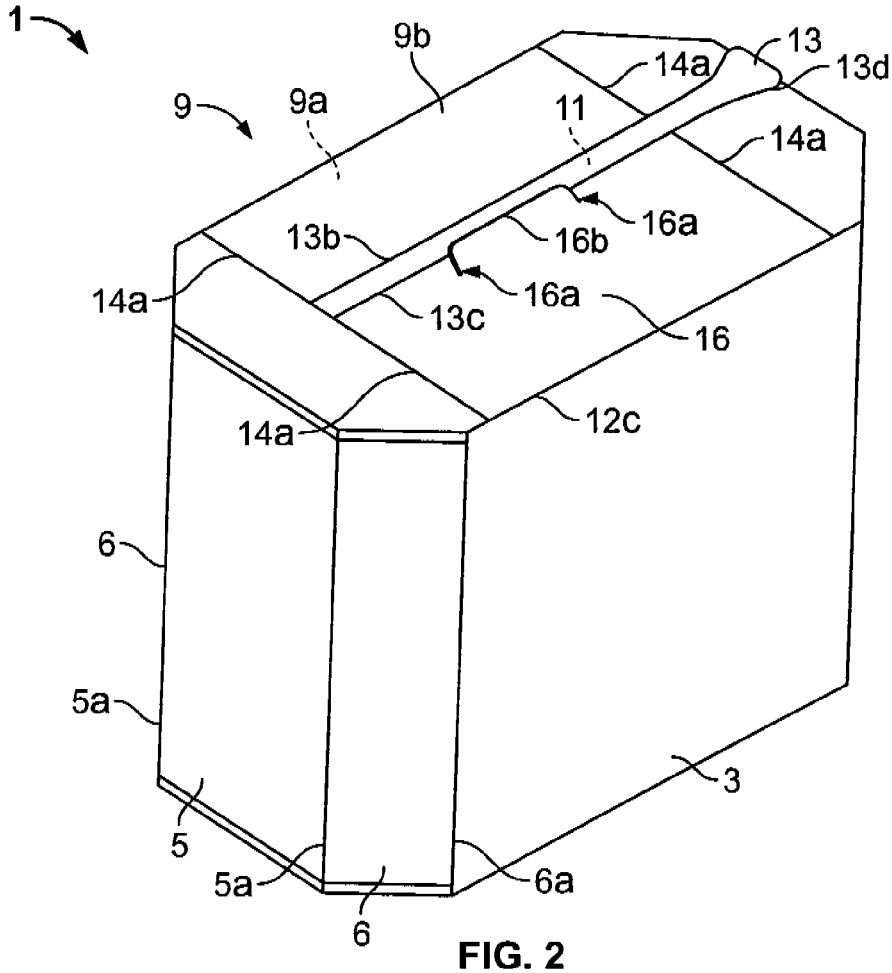
FIG. 2 is an isometric view of the polygonal carton shown in FIG. 1.
Figure 3:
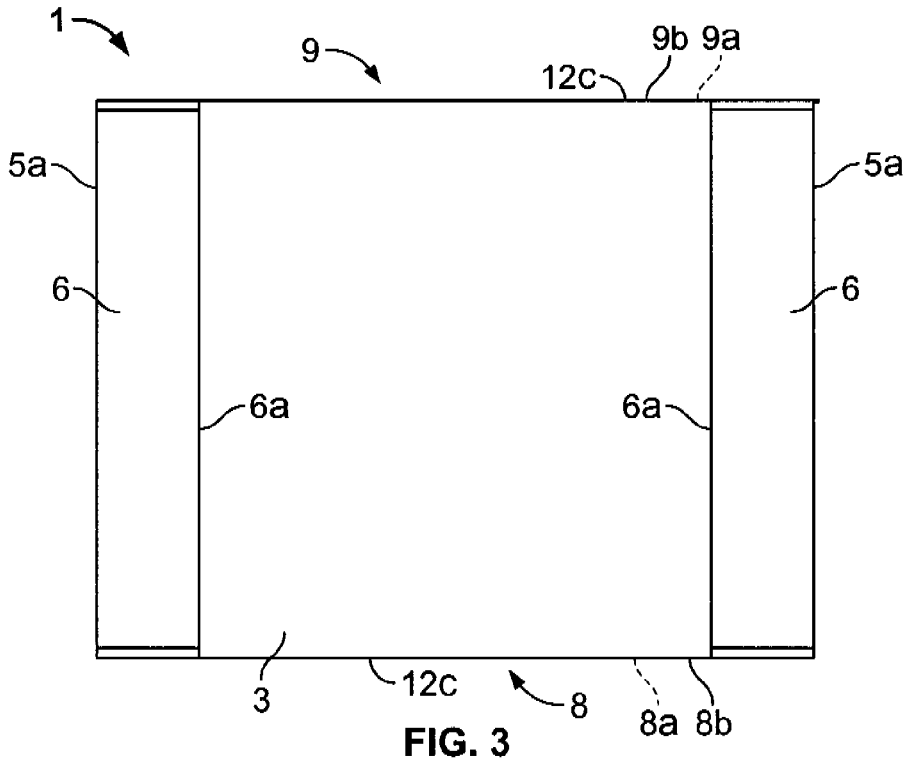
FIG. 3 is a front view of the carton shown in FIG. 1.
Figure 4:
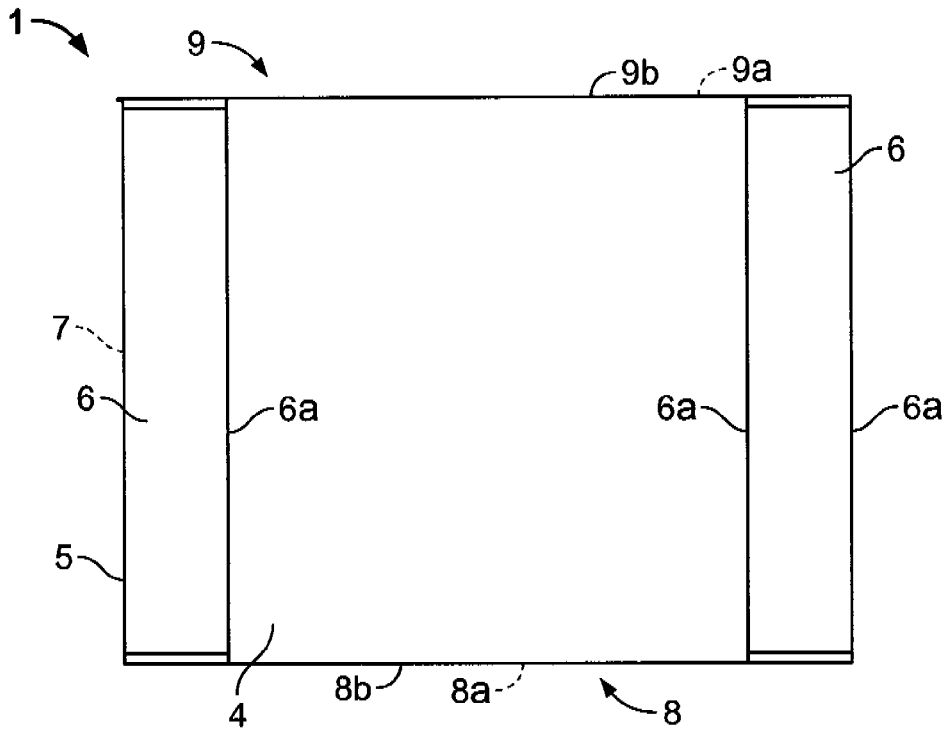
FIG. 4 is a rear view of the carton shown in FIG. 1.
Figure 5:
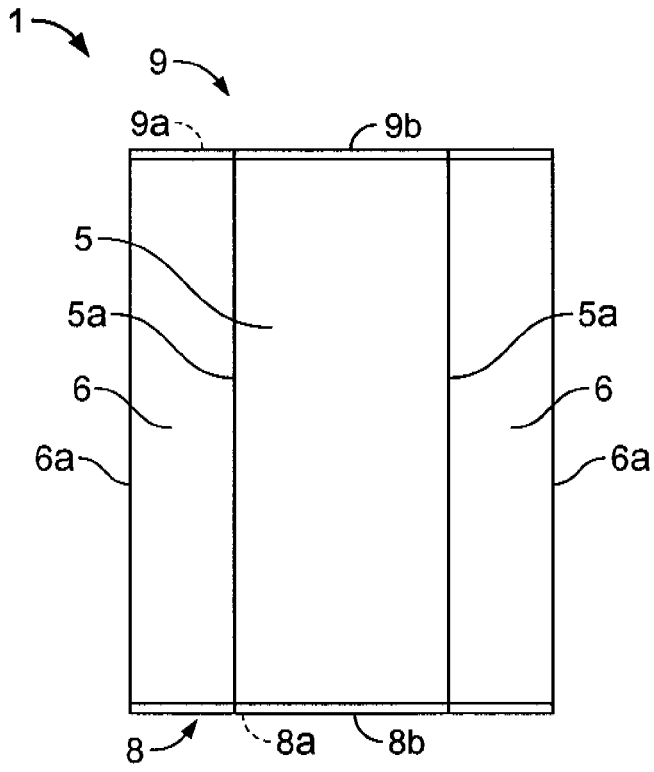
FIG. 5 is a side view of the carton shown in FIG. 1.
Figure 6:
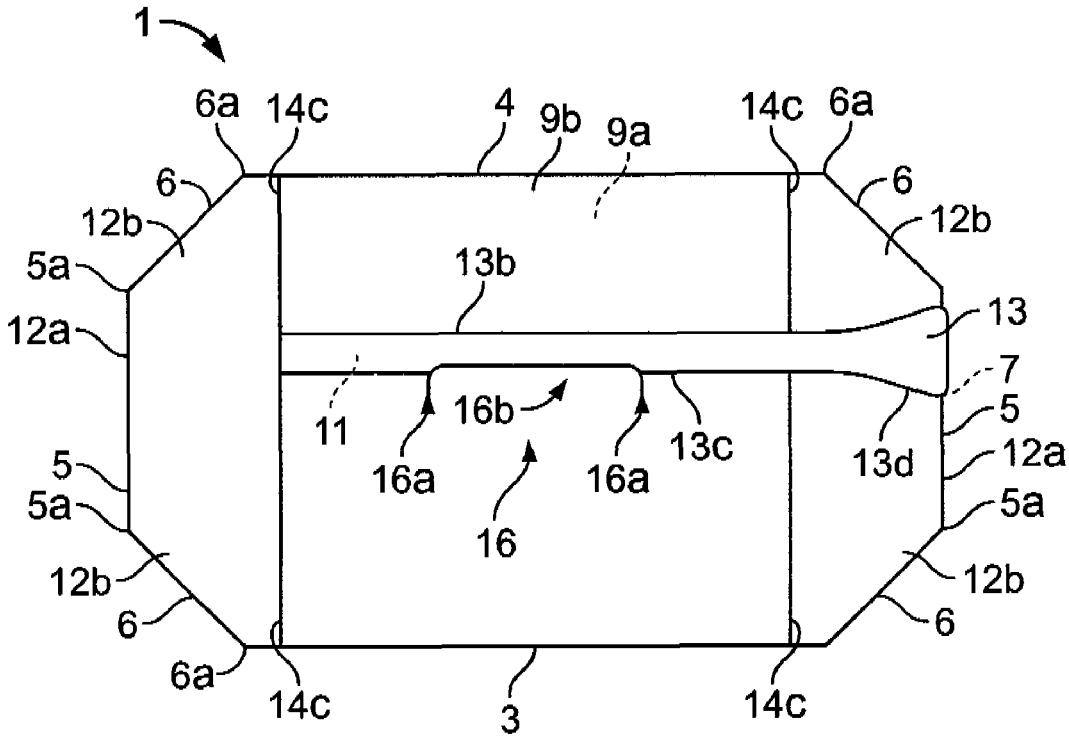
FIG. 6 is a top view of the carton shown in FIG. 1.
Figure 7:
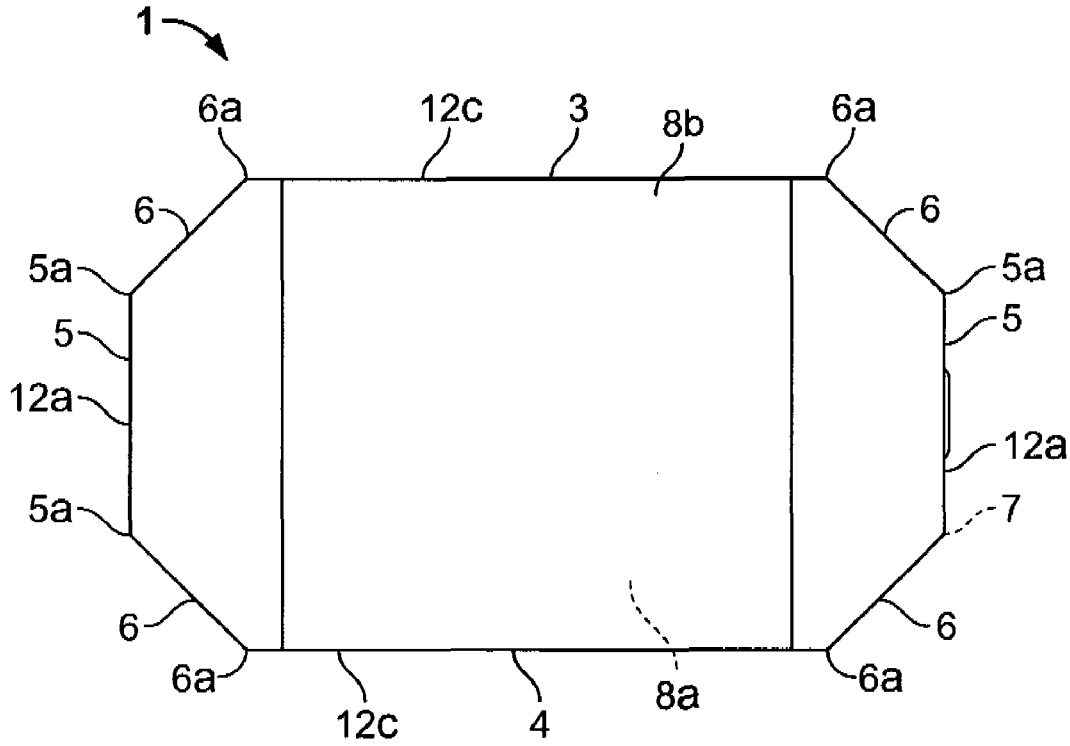
FIG. 7 is a bottom view of the carton shown in FIG. 1.

The present art overcomes the prior art limitations and sifting of granulated product by offset score, miter panels, and emboss pads at the four minor corners of the present invention. FIG. 1 illustrates a plan view of a reverse side of a blank 2 of an exemplary embodiment of an anti-sifting polygonal carton 1. FIG. 1A illustrates the glue 4 applied to blank 2, and FIG. 2 is an isomeric view of carton 1. FIGS. 3-5 are respective front, rear, and side views of carton 1 and FIGS. 6 and 7 are respective top and bottom view of carton 1. In the exemplary embodiment, anti-sifting polygonal carton 1 starts as a flat blank 2 that is somewhat H-shaped, and is generally symmetric, with four contiguous sections (2*a*, 2*b*, 2*c* and 2*d*). Specifically, the contiguous sections include a side section 2*a*, a front section 2*b*, a side section 2*c*, and a rear section 2*d*. Each side section 2*a* and 2*c* includes two miter panels 6 and rear section 2*d* includes notches 7*a* and a separate miter tab 7.

The first section 2*a*, or side panel 5, extends outward from the center of the blank 2 along the longitudinal axis of the blank 2. A side panel 5 is generally rectangular in shape and is positioned such that a longitudinal axis of the side panel 5 is substantially perpendicular to the longitudinal axis of the blank 2. The length of the side panel 5 establishes the general height of the finished carton 1. The side panel 5 has longitudinal creases 5*a* and lateral folds 12*a* of shorter length than the longitudinal creases 5*a*. Extending away from the lateral folds 12*a* upon both ends, minor flaps 10 have a generally trapezoidal shape with a short base and a substantially parallel long base that is spaced a distance from the short base with edges joining the two bases. The short base is substantially contiguous with the side panel 5 at a lateral end along a fold line 12*a*. Upon one or both edges, a minor flap 10 contacts a major flap or a major lower flap.

Flanking the side panel 5, miter panels 6 extend along the longitudinal creases 5*a* of the side panel 5. The longitudinal axes of miter panels 6 are substantially parallel to the longitudinal axis of the side panel 5. The miter panels 6 are generally rectangular shaped and each has a length that is less than, or equal to, approximately half the width of a side panel 5. The miter panels 6 also have lateral folds 12*b* and longitudinal creases 6*a*. The lateral folds 12*b* connect miter flaps 6*b* with miter panels 6. Miter flaps 6*b* are generally triangular shaped with the base of the triangle defined along the fold 12*b* and the vertex of the triangle positioned away from miter panel 6. As such, each end of each miter panel 6 includes a miter flap 6*b*. Although the miter flaps 6*b* are cut separate from the minor flaps 10, miter flap 6*b* do contact the major flaps and major lower flaps.

Extending away from first section 2*a*, towards the center of blank 2, second section 2*b* includes a front panel 3, as appended second major flap 9*b*, and a second major lower flap 8*b*. Front panel 3 has a generally rectangular shape with a longitudinal axis that is substantially parallel to the longitudinal axis of blank 2. Front panel 3 also has lateral ends that are contiguous with miter panel creases 6*a*, and longitudinal sides that are contiguous with folds 12*c* to second major flap 9*b* and to second major lower flap 8*b*.

The second major flap 9*b* has a generally trapezoidal shape defined by a short base and a substantially parallel long base that is spaced from the short base and is joined thereto joined by a pair of edges. The short base is contiguous with a fold 12*c* upon the longitudinal side of the front panel 3, and the long base is positioned away from the center of the blank 2, or towards the center of the assembled carton 1. The pair of edges are substantially straight and have an end proximate to the short base that is truncated at an approximate forty-five degree angle. The miter flaps 6*b* abut the second major flap 9*b* at the truncated edges. The second major flap 9*b* also has a tear strip 13 that extends across flap 9*b* adjacent to the long base.

Tear strip 13 is substantially parallel to, and spaced apart from, the long base, and the tear strip 13 enables a consumer to open the assembled carton 1. Specifically, in the exemplary embodiment, the tear strip 13 includes a thin line of tape 13*a* upon the reverse side to provide ripping strength. Moreover, the tear strip 13 creates a plurality of partial cuts 13*b* and 13*c* within the second major flap 9*b*. The first partial cut 13*b* is defined away from the center of the blank 2 and extends for substantially the full length of second major flap 9*b*. The second partial cut 13*c* is spaced apart from and is parallel to, first partial cut 13*b*, extends across two portions of second major flap 9*b*. And specifically, the second partial cut 13*c* includes two triangular shaped ears 16*a* and a center portion 16*b*, positioned such that a vertex of each triangle shape is towards the center of blank 2. Upon removal of tear strip 13, the tear strip ears 16*a* and center portion 16*b* form a male tab 16 that facilitates carton 1 being re-closed. Both the first and second partial cuts 13*b* and 13*c* expand outwardly with a taper near the side of carton 1. The width of tear strip 13 facilitates enabling a person to grip the tear strip 13.

The second major flap 9*b* also includes additional cuts 14*a* and 14*b* that extend substantially perpendicular to tear strip 13. Specifically, the third partial cut 14*a*, or outside cut, is near the miter corner and extends, across the width of second major flap 9*b*. Cut 14*a* extends through the depth of blank 2, but does not penetrate the reverse face of blank 2. Parallel and inward of outside cut 14*a*, the fourth partial cut 14*b*, or inside cut, extends from the fold to the second partial cut 13*c*. Similarly, to outside cut 14*a*, the inside cut 14*b* penetrates the blank 2, but not the reverse face of blank 2.

Opposite the second major flap 9*b*, second section 2*b* includes the second major lower flap 8*b*. The second major lower flap 8*b* is generally trapezoidally-shaped and includes a short base and a substantially parallel long base that is spaced apart from, and joined to the short base by a pair of edges. The short base is formed contiguously with a fold 12*c* extending across the longitudinal side of front panel 3. The long base is spaced from the center of the blank 2 towards the center of the assembled carton 1. The pair of edges are substantially straight and have an end proximate to the short base that is truncated at an approximate forty-five degree angle. The miter flaps 6*b* abut the second major lower flap 8*b* at the truncated edges. The second major lower flap 8*b* has a crease 12*d* that extends across flap 8*a* and is adjacent to the long base. In the exemplary embodiment, the crease 12*d* extends substantially parallel to the long base and overlaps the long base of first major lower flap 8*a*. The crease 12*d* permits the second major lower flap 8*b* to fold over first major lower flap 8*a* to form the sealed bottom 8 of carton 1.

Contiguous with the front panel 3, and opposite first section 2*a*, third section 2*c* is formed substantially similar to the first section 2*a*. The third section 2*c* extends outward from a side panel 5, and more specifically, extends outward from the center of blank 2 along the longitudinal axis of blank 2. This side panel 5 has a generally rectangular shape and is oriented such that the longitudinal axis of the side panel 5 is substantially perpendicular to the longitudinal axis of blank 2. Similar to first section 2*a*, the length of this side panel 5 establishes the general height of the finished carton 1. The side panel 5 includes longitudinal creases 5*a* and lateral folds 12*a* that have a shorter length than the longitudinal creases 5*a*. Extending away from the lateral folds 12*a* at both ends, minor flaps 10 have a generally trapezoidal shape defined by a short base and a substantially parallel long base that is spaced apart from, and is joined to the short based by a pair of edges. The short base is formed contiguously with the side panel 5 along a fold line 12*a* at a lateral end of side panel 5. At both edges, the minor flap 10 contacts a major and major lower flap.

Miter panel 6, flank the side panel 5, and couple the longitudinal creases 5*a* of side panel 5 together. The longitudinal axes of the miter panels 6 are substantially parallel to the longitudinal axis of side panel 5. The miter panels 6 are generally rectangular shaped and have a width that is less than, or equal to, approximately half the width of a side panel 5. The miter panels 6 also include lateral folds 12*b* and longitudinal creases 5*a*. The lateral folds 12*b* connect the miter flaps 6*b* with the miter panels 6. More specifically, the miter flaps 6*b* are generally triangular shaped and are oriented such that a base of the triangle is on the fold and the vertex of the triangle is spaced a distance away from the miter panel 6. Each end of a miter panel 6 includes a miter flap 6*b*. Notably, although the miter flaps 6*b* are cut separately from the minor flaps 10, each miter flap 6*b* contacts the major flap and major lower flaps.

Fourth section 2*d* is formed contiguous with the third section 2*c*, or side panel 5, and includes the rear panel 4, appended first major flap 9*a*, first major lower flap 8*a*, and miter tab 7. Rear panel 4 has a generally rectangular shape with a longitudinal axis that is substantially parallel to the longitudinal axis of blank 2. Moreover, the rear panel 4 includes lateral ends that are contiguous with creases 6*a* 7*b* to a miter panel 6 and to miter tab 7, and longitudinal sides that are contiguous with folds 12*c* to major flap 9*a* and to major lower flap 8*a*.

First major flap 9*a* is generally trapezoidal shaped with a short base and a substantially parallel long base that is spaced apart from, and joined to, the short base by a pair of edges. The short base is formed contiguously with a fold 12*c* defined on the longitudinal side of rear panel 4, and the long base is positioned away from the center of the blank 2, towards the center of the assembled carton 1. The edges are substantially straight and with an end proximate to the short base that is truncated at an approximate 45° angle. A miter flap 6*b* abuts the second major flap 9*b* at the truncated edge closer to the center of blank 2. First major flap 9*a* is formed with a rectangular notch 17 along the long base.

Similar to second major flap 9*b*, after tear strip 13 has been removed, ears 16*a* and center portion 16*b* form a male tab 16. The male tab 16 formed is sized to fit into the female notch 17 defined along the long base of first major flap 9*a*. More specifically, when male tab 16 is inserted within female notch 17, the top 9 of carton 1 is closed. In blank form 2, first and second major flaps 9*a* and 9*b* have approximately the same width.

Major flap 9*a* is formed with a plurality of cuts 15*a* and 15*b* that each extend substantially perpendicular to fold 12*c*. The first cuts 15*a*, or outside cuts, are near the miter corners and extend across the width of the first major flap 9*a*. Cuts 15*a* extend through the depth of blank 2, but do not penetrate the reverse face of blank 2. Parallel and inward of outside cut 15*a*, the second cuts 15*b*, or inside cuts, extend from fold 12*c* towards the long base. Similarly to the outside cuts 15*a*, the inside cuts 15*b* penetrate blank 2 but not the reverse face of blank 2.

Opposite the first major flap 9*a*, fourth section 2*d* includes the first major lower flap 8*a*. The first major lower flap 8*a* is generally trapezoidal shaped and includes a short base and substantially parallel long base that is spaced apart from, and joined to, the short base by a pair of edges. The short base is formed contiguously with a fold extruding across the longitudinal side of front panel 3. The long base is spaced from the center of blank 2 towards the center of the assembled carton 1. The pair of edges are substantially straight and have an end proximate to the short base that is truncated at an approximate 45° angle. A miter flap 6*b* abuts the first major lower flap 8*a* at a truncated edge. The fourth section 2*d* is opposite the miter panel 6 of third section 2*c*, and includes a miter tab 7 that extends from the opposite end of rear panel 4. Miter tab 7 has approximately the same width as miter panel 6 and is formed with a slight trapezoidal shape. The long base miter tab 7 forms a crease 7*b* to rear panel 4 and the short base is substantially parallel to the long base and is free for attachment to first section 2*a* during assembly of carton 1. Unlike other miter panels 6, the miter tab 7 lacks miter flaps 6*b*. Moreover, the edges of miter tab 7 taper slightly away from the center of blank 2 such that notches 7*a* are formed.

As shown in FIG. 1A, in the exemplary embodiment, the reverse face of blank 2 has adhesive 18 applied to seal the bottom 8 and later the top 9 of carton 1. More specifically, in the exemplary embodiment, the reverse face has adhesive 18 applied in a generally triangular pattern to each minor flap 10 at each end of the short base. The vertex of the triangular adhesive pattern points towards the intersection of the fold 12*b* and the crease 5*a* for the miter panel 6, while the base of each triangular adhesive pattern extends towards, and is substantially parallel to, the long base of the miter panel 6. In the exemplary embodiment, blank 2 includes eight generally triangular adhesive patterns.

Away from the miter panels 6, miter tab 7 has adhesive 18 applied across substantially its full length. Adhesive 18 facilitates securing miter tab 7 to miter panel 6 during assembly of carton 1. Adhesive 18 is also applied outwards from miter panel 6, to first major flap 9*a* and first major lower flap 8*a* along both edges of flaps 8*a* and 9*a*. More specifically, such adhesive 18 is applied to extend from the long base towards the short base along each flap 8*a* and 9*a*. During assembly, such adhesive 18 facilitates securing each flap 8*a* and 9*a* to lower minor flaps 10 after carton 1 is filled. Adhesive is also applied to second major flap 9*b* and second major lower flap 8*b*. More specifically, in the exemplary embodiment, adhesive 18 is applied along the long base of both flaps 8*b* and 9*b* and the edges of both flaps 8*b* and 9*b*, in a manner that is similar to adhesive applied to first major flap 9*a* and first lower major flap 8*a*.

Upon folding blank 2 with specialized machinery, described in more detail below, carton 1 is filled with a product, and second major flap 9*b* is closed upon first major flap 9*a*. Carton 1, when fully assembled, has a front established by the generally rectangular shaped front panel 3 and two flanking miter panels 6. In the exemplary embodiment, the miter panels 6 extend rearward from front panel 3 at an approximate forty-five degree angle. Side panels 5 extend further rearward from each miter panel 6. Specifically, in the exemplary embodiment, the side panels 5 are generally perpendicular to front panel 3 and have a rectangular shape of lesser width than front panel 3.

Two additional miter panels 6 extend rearward from each side panel 5 at an approximate forty-five degree angle towards the rear panel 4. The rear panel 4 is oriented substantially parallel to, and spaced apart from, front panel 3. As such, when fully assembled, carton 1 has a generally octagonal shape and is generally symmetric about three axes when assembled and closed. Carton 1 has a top 9 that is closed after carton 1 is filled with product. Top 9 is substantially perpendicular to front panel 9 and is formed as the second major flap 9*b* is folded inward upon the first major flap 9*a* which is also folded inward. In the exemplary embodiment, each flap 9*a* and 9*b* is sized to extend fully across top 9 when folded to close top 9. When assembled as such, the tear strip 13 of second major flap 9*b* is positioned across top 9 to enable a consumer to use in opening carton 1.

As shown in FIG. 3, the width of front panel 3 establishes the length of the finished carton 1. The front panel 3 has a generally rectangular shape with two ends that are substantially perpendicular to the longitudinal axis of front panel 3. A miter panel 6 extends rearward from each end of panel 3 at a crease 6*a*. Specifically, at each panel end, carton 1 has gaps 7*c* that may be defined adjacent the top 9 and the bottom 8 of carton 1. More specifically, in the front, the gaps 7*c* are created when the second major flap 9*b* is folded over the first major flap 9*a*, and when the second major lower flap 8*b* is folded over the first major lower flap 8*a*. To substantially prevent, if not eliminate sifting through gaps 7*c*, miter flaps 6*b* extending from the miter panels 6, substantially seal the gaps 7*c* beneath the second major flap 9*b* and the second major lower flap 8*b*.

The rear of carton 1 is opposite the carton front, as shown in FIG. 4, and is defined by a rear panel 4. In the exemplary embodiment, rear panel 4 has a generally rectangular shape and is oriented such that two ends are substantially perpendicular to the longitudinal axis of front panel 3. A miter panel 6 extends rearward from each rear panel end at a crease 6*a*. Towards the left of carton 1, rear panel 4 includes an edge 7*c* wherein miter tab 7 is secured to a miter panel 6. Towards the top 9 of carton 1, the second major flap 9*b* includes an edge 9*c* extending along the length of carton 1, and towards the bottom 8 of carton 1, the second major lower flap 8*b* includes an edge extending along the length of carton 1. At each end, gaps are defined at the carton top 9 and bottom 8. Moreover, towards the rear of carton 1, the gaps 7*c* are created when the first major flap 9*a* is folded beneath the second major flap 9*b*, and the first major lower flap 8*a* is folded under the second major lower flap 8*b*. Miter flaps 6*b*, extending from miter panels 6, facilitate sealing the gaps 7*c* above the first major flap 9*a* and the first major lower flap 8*a* to facilitate anti-sifting.

As shown more clearly in FIG. 5, a side of carton 1 is generally rectangular in shape as defined by side panel 5. Moreover, side panel 5 defines the height and depth of carton 1. Each side includes two longitudinal edges. Miter panels 6 extend approximately forty-five degrees away from each longitudinal side panel edge towards the center of carton 1. In the exemplary embodiment, the miter panels 6 are narrower than side panel 5. At the top 9 of carton 1, the edges of the second major flap 9*b* are folded and glued upon the first major flap 9*a*. Similarly, at the bottom 8 of carton 1, the second major lower flap 8*b* is folded over and glued upon the first major lower flap 8*a*.

As best illustrated in FIG. 6, a top 9 of carton 1, when sealed, facilitates containing product during shipment and handling, and enables a consumer to release product from carton 1 via tear strip 13. Specifically, when the front panel 3, side panels 5, and rear panel 4 are coupled by contiguous miter panels 6 and miter tab 7, the carton 1 has a generally octagonal shape. Front panel 3 and rear panel 4 are the widest panels, and miter panels 6 are the narrowest panels.

Tear strip 13 extends substantially parallel to, and spaced apart from, the edge 9*c* of second major flap 9*b*. Tear strip 13 includes a thin line of tape 11 upon the reverse face of second major flap 9*b*, and is formed with a plurality of partial cuts. Specifically, the first partial cut 13*b* is towards the edge, and extends for the length of second major flap 9*b*. The second partial cut 13*c* is spaced apart from, and substantially parallel to, the first partial cut 13*b*. The second partial cut 13*c* extends across two portions of the second major flap 9*b* and includes has two triangular shaped ears 16*a* and a center portion that are oriented such that the vertex of the triangle shape extends towards the center of the blank 2. Upon removal of tear strip 13, the ears 16*a* and the center portion form a male tab 16 that enables carton 1 to be re-closed.

The carton top 9 is also formed with additional cuts that facilitate positioning the second and first major flaps 9*a* and 9*b* away from the mitered and sealed corners. The second major flap 9*b* includes cuts that extend substantially perpendicular to tear strip 13. Specifically, the third partial cuts or outside cuts 14*a* are positioned closer to the miter panels 6 and extend substantially across the width of the second major flap 9*b*, whereas the fourth partial cuts or inside cuts 14*b* extend from the fold to the second partial cut 13*c*. Specifically, the fourth partial cuts 14*b* are substantially parallel to, and inward of, the outside cuts 14*a*. The outside cuts 14*a* and the inside cuts 14*b* extend through the depth of blank 2, but do not penetrate the reverse face of blank 2.

Beneath the second major flap 9*b*, the first major flap 9*a* includes cuts that are formed substantially collinear with cuts 14*a* and 14*b* upon the second major flap 9*b*. The first partial cuts or outside cuts 15*a* are near the miter panels 6 and extend substantially across the width of the first major flap 9*a*. The second partial cuts or inside cuts 15*b* extend from the fold towards the long base. The outside cuts 15*a* and the inside cuts 15*b* extend through the depth of the blank 2, but do not penetrate the reverse face of blank 2. The cuts 14*a*, 14*b*, 15*a*, and 15*b*, formed in top 9, define a rectangular portion of the top 9 for separation from the sealed corners.

As best illustrated in FIG. 7, carton 1 has a bottom 8 that is generally octagonal shaped that is defined as the second major lower flap 8*b* is folded over the first major lower flap 8*a*. The second major lower flap 8*a* includes a crease 12*d* that extends substantially parallel to the longitudinal axis of carton 1 and that overlaps the long edge of the first major lower flap 8*a*. The crease 12*d* enables the second major lower flap 8*b* to bend over the first major lower flap 8*a* to substantially seal the bottom 8 of carton 1.

During use, to release product from carton 1, a consumer initially removes tear strip 13. As described above, the tear strip 13 has partial knife cuts 13*b* and 13*c* that are backed by tape 11 extending along the length of the second major flap 9*b*. After pulling and removing tear strip 13, further opening occurs along partial and full die cuts 14*a*, 14*b*, 15*a*, and 15*b*, as well as along perforations that enable a consumer to pull away the remaining second major flap 9*b*. The hinged connection of the second major flap 9*b* to the carton 1 facilitates a consumer easily separating the second major flap 9*b* from the remainder of top 9. Similarly, the first major flap 9*a* is opened by the consumer in a similar manner. Both major flaps 9*a* and 9*b* rotate about a fold line 12*c* after delaminating from full die cuts 14*a* and 14*b*. The full die cuts, extending through the press applied tape 11, cleanly expose the remainder of the major flaps 9*a* and 9*b* and the male re-close feature 16. On the second major flap 9*b* a, the partial die cuts 14*a* and 14*b* are formed with a sufficient depth to cut the press applied tape 11 such that top 9 may be opened along the inside and the outside partial cuts 14*a* and 14*b*. The paperboard then delaminates and reveals the granulated product within the carton 1.

To close the carton 1, a consumer initially rotates the first major flap 9*a* towards the carton top 9. The first major flap 9*a* is formed with a female notch 17 while the second major flap 9*b* is formed with a male tab 16. After the second major flap 9*b* is rotated, the male tab 16 may be inserted into the female notch 17. As the second flap 9*b* is pressed against the first flap 9*a*, the male tab 16 and female notch 17 are interlocked and carton 1 is re-closed.

In the exemplary embodiment, a specialized machine is used to form carton 1 from a blank of sheet material, such as blank 2. The machine will be discussed hereafter with reference to forming carton 1 from blank 2. However, the machine may be used to form a carton having any size, shape, or configuration from a blank having any size, shape, or configuration without departing from the scope of the present invention.

In the exemplary embodiment, the machine includes a loading section for loading blanks 2 into the machine for formation into cartons 1. Specifically, each blank 2 is loaded into a loading frame that supports the blank 2 in a generally vertical position. A conveyor moves the blank 2 into a transfer section as the loading frame supports the blank 2. A gripping member lifts the blank 2 out of the loading frame and places it onto a support in a generally horizontal position. Although any suitable gripping mechanism, structure, and/or means may be used to lift the blank 2 out of the loading frame and onto the support without departing from the scope of the present invention, in one embodiment the gripping member includes a plurality of vacuum cups connected to a rotating frame. The vacuum cups attach to the blank 2 and grip the blank 2 as the rotating frame positions the blank 2 over the support in front of a pusher assembly. The vacuum cups then release their grip to place the blank 2 onto the support.

The pusher assembly pushes the blank over three hot melt glue guns wherein adhesive is applied to surfaces of carton 1 as described above. The pusher assembly guides the blank 2 along the support until the blank is underneath a mandrel mounted on the machine. The mandrel has an external shape that is complimentary to at least a portion of an internal shape of the carton 1 formed from the blank. The pusher assembly pushes the blank 2 along the support such that the rear panel is positioned underneath the mandrel and the fold lines are aligned with respective outer edges of the mandrel. Any suitably configured member may be used to facilitate folding carton 1 as described herein. For example, a flap folder member may be used to fold the carton flaps to assembly carton 1.

In each embodiment, an anti-sifting carton assembled has a polygonal shape, such as an octagon. The carton is capable of storing granulated product such that sifting of the product from the carton is facilitated to be minimized. Moreover, the above-described carton also facilitates reducing sealing and forming problems that may be associated with known cartons. Generally, the present invention provides a single piece bulk granular product carton that is formed from a single blank having major flaps, lower major flaps, minor flaps, miter flaps, emboss pads, a front panel, a real panel, miter panels, notches, and a tear strip. The panels form the octagonal-shaped carton with the flaps used for sealing the ends of the carton. Specially, the flaps overlap to seal the four corners of each end. As a result, the sealed ends, facilitated reducing sifting and/or other losses of granulated product from the carton in a cost-effective and reliable manner.

Exemplary embodiments of anti-sifting cartons are described above in detail. The cartons are not limited to use with the specific embodiments described herein, but rather, components of each carton can be utilized independently and separately from other carton components described herein. Moreover, the invention is not limited to being used with granulated products. Rather, other products may be contained within the carton within the spirit and scope of the claims.

While the invention has been described in terms of various specific embodiments, those skilled in the art will recognize that the invention can be practiced with modification within the spirit and scope of the claims.

What is claimed is:

1. A carton for packaging a product, said carton formed from a single blank of material and comprising:

a front panel;

an opposite rear panel spaced a distance from said front panel, said rear panel substantially parallel to said front panel;

a plurality of side panels oriented substantially perpendicularly to said front panel;

a top comprising a tear strip formed integrally therewith, at least a first cut line extending substantially parallel to the tear strip, and at least a second cut line extending substantially perpendicular to the tear strip and across substantially an entire width of the top, the tear strip being removable from the top to facilitate removing product from the carton, and the second cut line being configured to facilitate removal of at least a portion of the top from the carton;

a bottom opposite the top; and a plurality of miter panels extending contiguously with said side panels, said front panel, and said rear panels, wherein said front panel, said rear panel, and said plurality of side panels each extend between said top and said bottom, and wherein a portion of one of said miter panels is configured to secure said rear panel to at least one of said side panels such that sifting of the product from said carton is facilitated to be prevented when said carton is fully assembled.

2. A carton in accordance with claim 1 wherein each of said plurality of miter panels comprises at least one miter flap configured to facilitate sealing said carton to prevent sifting of the product from said carton.

3. A carton in accordance with claim 2 wherein each of said at least one miter flaps is triangular-shaped and comprises an emboss pad, said emboss pad facilitating assembly of said carton.

4. A carton in accordance with claim 2 wherein said at least one miter flap comprises a plurality of upper miter flaps and a plurality of lower miter flaps, each of said plurality of upper miter flaps extends outward from each of said miter panels adjacent said top, and each of said plurality of lower miter flaps extends outward from each of said miter panels adjacent said carton bottom.

5. A carton in accordance with claim 1 wherein said top further comprises a first major flap and a second major flap, and wherein a portion of said first major flap is configured to interlock with a portion of said second major flap after said tear strip has been removed.

6. A carton in accordance with claim 1 wherein said top comprises a first major flap and a second major flap, and at least one minor flap, and wherein said first major flap is folded beneath said second major flap and said at least one minor flap when said top is closed.

7. A carton in accordance with claim 1 wherein said bottom comprises a first major flap and a second major flap, and at least one minor flap, and wherein said first major flap is folded beneath said second major flap and said at least one minor flap when said carton bottom is closed.

8. A carton in accordance with claim 1 wherein said carton has an octagonal shape when fully assembled.

9. A method of assembling a carton for packaging a product, said method comprising:

providing a single blank of material;

forming a carton having at least five sides and including a front panel, an opposite rear panel that is spaced a distance from the front panel, and at least two side panels extending substantially perpendicularly from the front panel;

folding a first major lower flap over a second major lower flap and over at least one minor lower flap to form a bottom for the carton, wherein the first and second major lower flaps and the at least one minor lower flap facilitate preventing sifting of the product from the carton; and folding a first major upper flap over a second major upper flap and over at least one minor upper flap to form a top for the carton, wherein the first and second major upper flaps and the at least one minor upper flap facilitate preventing sifting of the product from the top of the carton;

providing a tear strip formed integrally with one of the first major upper flap and the second major upper flap, wherein the tear strip facilitates removing product from the carton;

forming at least a first cut line extending substantially parallel to said tear strip in one of the first major upper flap and the second major upper flap; and forming at least a second cut line extending substantially perpendicular to said tear strip in one of the first major upper flap and the second major upper flap and across substantially an entire width of the top, wherein the second cut line is configured to facilitate removal of at least a portion of the top from the carton.

10. A method in accordance with claim 9, wherein forming a carton having at least five sides further comprises forming the carton to include a plurality of miter panels that extend contiguously with the side panels, the front panel, and the rear panel.

11. A method in accordance with claim 10, further comprising folding at least a portion of each miter panel to facilitate coupling the rear panel to at least one side panel.

12. A method in accordance with claim 9 wherein forming a carton having at least five sides further comprises forming the carton to have an octagonal shape when fully assembled.

* * * * *